US008406443B2

(12) United States Patent
Westerkull et al.

(10) Patent No.: US 8,406,443 B2
(45) Date of Patent: Mar. 26, 2013

(54) BONE ANCHORED BONE CONDUCTIVE HEARING AID

(75) Inventors: Patrik Westerkull, Smørum (DK); Lars Jinton, Smørum (DK)

(73) Assignee: Oticon Medical A/S, Smorum (DK)

( * ) Notice: Subject to any disclaimer, the term of this patent is extended or adjusted under 35 U.S.C. 154(b) by 486 days.

(21) Appl. No.: 12/780,560

(22) Filed: May 14, 2010

(65) Prior Publication Data

US 2010/0292529 A1 Nov. 18, 2010

(30) Foreign Application Priority Data

May 14, 2009 (EP) ..... 09160282

(51) Int. Cl.
*H04R 25/02* (2006.01)
*H04R 25/00* (2006.01)

(52) U.S. Cl. ..... 381/326; 381/151; 381/380; 600/25

(58) Field of Classification Search ..... 381/326, 381/322, 23.1, 151, 380, 374; 606/72, 75, 606/129; 600/379, 25; 607/137
See application file for complete search history.

(56) References Cited

U.S. PATENT DOCUMENTS

| | | | | |
|---|---|---|---|---|
| 3,732,621 | A | 5/1973 | Bostrom | |
| 4,498,461 | A * | 2/1985 | Hakansson | 600/25 |
| 4,793,808 | A | 12/1988 | Kirsch | |
| 4,904,233 | A * | 2/1990 | Håkansson et al. | 600/25 |
| 5,087,200 | A | 2/1992 | Brajnovic et al. | |
| 5,135,395 | A | 8/1992 | Marlin | |
| 5,571,015 | A | 11/1996 | Siegmund | |
| 5,735,790 | A * | 4/1998 | Håkansson et al. | 600/25 |
| RE35,784 | E | 5/1998 | Linkow et al. | |
| 5,935,170 | A * | 8/1999 | Håkansson et al. | 600/25 |
| 6,053,920 | A | 4/2000 | Carlsson et al. | |
| 7,021,676 | B2 * | 4/2006 | Westerkull | 285/321 |
| 7,065,223 | B2 * | 6/2006 | Westerkull | 381/326 |
| 7,116,794 | B2 * | 10/2006 | Westerkull | 381/326 |
| 7,160,244 | B2 * | 1/2007 | Westerkull | 600/25 |
| 7,198,596 | B2 * | 4/2007 | Westerkull | 600/25 |
| 7,376,237 | B2 * | 5/2008 | Westerkull | 381/326 |
| 7,409,070 | B2 * | 8/2008 | Pitulia | 381/326 |
| 8,005,247 | B2 * | 8/2011 | Westerkull | 381/318 |
| 8,059,844 | B2 * | 11/2011 | Westerkull et al. | 381/322 |
| 8,144,908 | B2 * | 3/2012 | Åsnes | 381/326 |
| 8,184,840 | B2 * | 5/2012 | Spitaels et al. | 381/326 |
| 8,216,287 | B2 * | 7/2012 | Parker | 606/300 |
| 2005/0249366 | A1 * | 11/2005 | Westerkull | 381/151 |

(Continued)

FOREIGN PATENT DOCUMENTS

| | | |
|---|---|---|
| DE | 2802602 A1 | 8/1978 |
| EP | 0216031 A1 | 4/1987 |

(Continued)

*Primary Examiner* — Edgardo San Martin
(74) *Attorney, Agent, or Firm* — Birch, Stewart, Kolasch & Birch, LLP

(57) ABSTRACT

The invention relates to a bone anchored bone conductive hearing aid which has a bone implantable screw (3) with an implant axis (25) intended to be generally perpendicular to a bone surface at an implant point and a skin penetrating abutment (5) which is connected to the implantable screw (3) through a contact surface (16) at a contra-lateral end thereof where the abutment (5) at a lateral end thereof has a coupling surface (15) whereto a hearing aid is detachably coupled along a hearing aid coupling axis (20) the implant axis (25) and the hearing aid coupling axis (20) are arranged at an angle α with respect to each other.

7 Claims, 5 Drawing Sheets

U.S. PATENT DOCUMENTS

| | | | | |
|---|---|---|---|---|
| 2006/0126874 | A1* | 6/2006 | Westerkull | 381/326 |
| 2006/0211910 | A1* | 9/2006 | Westerkull | 600/25 |
| 2007/0009853 | A1* | 1/2007 | Pitulia | 433/173 |
| 2007/0053536 | A1* | 3/2007 | Westerkull | 381/326 |
| 2009/0082817 | A1* | 3/2009 | Jinton et al. | 606/301 |
| 2009/0245554 | A1* | 10/2009 | Parker | 381/326 |
| 2009/0248023 | A1* | 10/2009 | Parker | 606/60 |
| 2010/0286776 | A1* | 11/2010 | Andersson | 623/16.11 |
| 2011/0158443 | A1* | 6/2011 | snes et al. | 381/326 |
| 2012/0078035 | A1* | 3/2012 | Andersson et al. | 600/25 |
| 2012/0095284 | A1* | 4/2012 | Westerkull et al. | 600/25 |
| 2012/0172658 | A1* | 7/2012 | Bjorn et al. | 600/25 |
| 2012/0215056 | A1* | 8/2012 | Hillbratt et al. | 600/25 |

FOREIGN PATENT DOCUMENTS

| | | | |
|---|---|---|---|
| EP | 0323421 | A2 | 7/1989 |
| EP | 0497082 | A1 | 8/1992 |
| EP | 0715839 | A2 | 6/1996 |
| EP | 1547543 | A1 | 6/2005 |
| WO | WO 83/02047 | A1 | 6/1983 |
| WO | WO 98/55049 | A1 | 12/1998 |
| WO | WO 2007/024657 | A2 | 3/2007 |

* cited by examiner

BONE ANCHORED BONE CONDUCTIVE HEARING AID

TECHNICAL FIELD

The present invention relates to a bone anchored bone conductive hearing aid. The invention relates specifically to a bone anchored bone conductive hearing aid which has a bone implantable screw with an implant axis intended to be generally perpendicular to a bone surface at an implant point and a skin penetrating abutment which is connected to the implantable screw through a contact surface at a contra-lateral end thereof where the abutment at a lateral end thereof has a coupling surface whereto a hearing aid is detachably coupled along a hearing aid coupling axis.

BACKGROUND ART

Bone anchored bone conduction hearing aids are essential for the rehabilitation of patients suffering from some specific type of hearing loss for which traditional hearing aids are insufficient. This type of device consists of an external hearing aid with a vibrating transducer which is connected via a coupling to a skin penetrating abutment mounted on an implant fixture anchored in the skull bone. It is important that the coupling is sufficiently firm, to avoid poor transmission of the vibrations, but it is also important that the coupling is not too firm, since it is also important that the hearing aid falls off in case of a sudden impact, to avoid that the skull bone anchoring is damaged. In a coupling like this there are always coupling forces pressing components in the connection against the abutment. The coupling forces can be generated by a separate spring, a flexible material or by a magnet. The patient takes on and off the hearing aid daily, so wear and tear durability of the coupling is also important.

DISCLOSURE OF INVENTION

In some cases with conventional implant systems, the implant fixture, anchored in the skull bone, can end up in an unsuitable position due to anatomical variations.

An object of the present invention is to provide a hearing aid which overcomes this problem.

The object of the invention is achieved by a bone anchored hearing aid as defined above wherein the implant axis and the hearing aid coupling axis are arranged at an angle $\alpha$ with respect to each other By providing such an angle between the two axes it is ensured that the hearing aid may rest coupled on the abutment, without touching the skin of the user at any other point.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
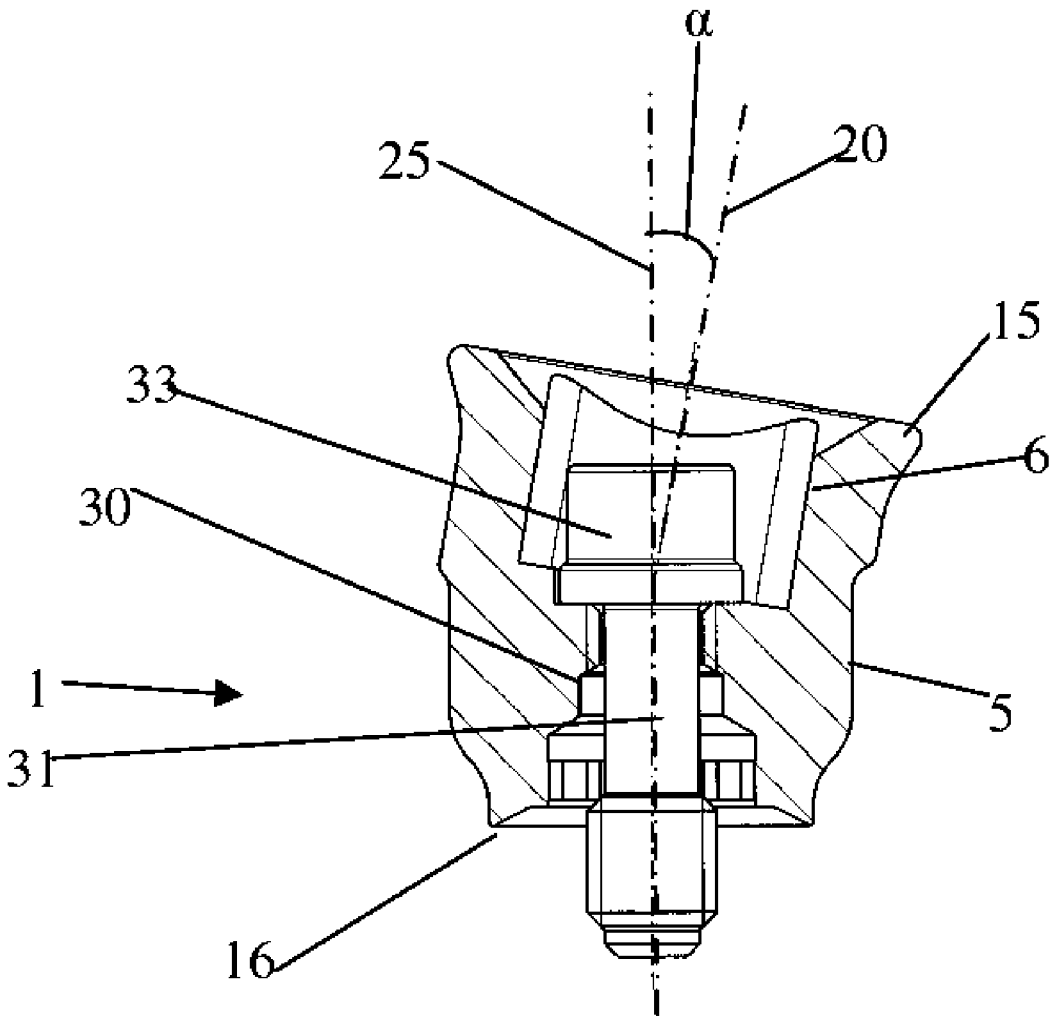
FIG. 1 shows a sectional side view of the angled abutment with a connection screw.
Figure 2:
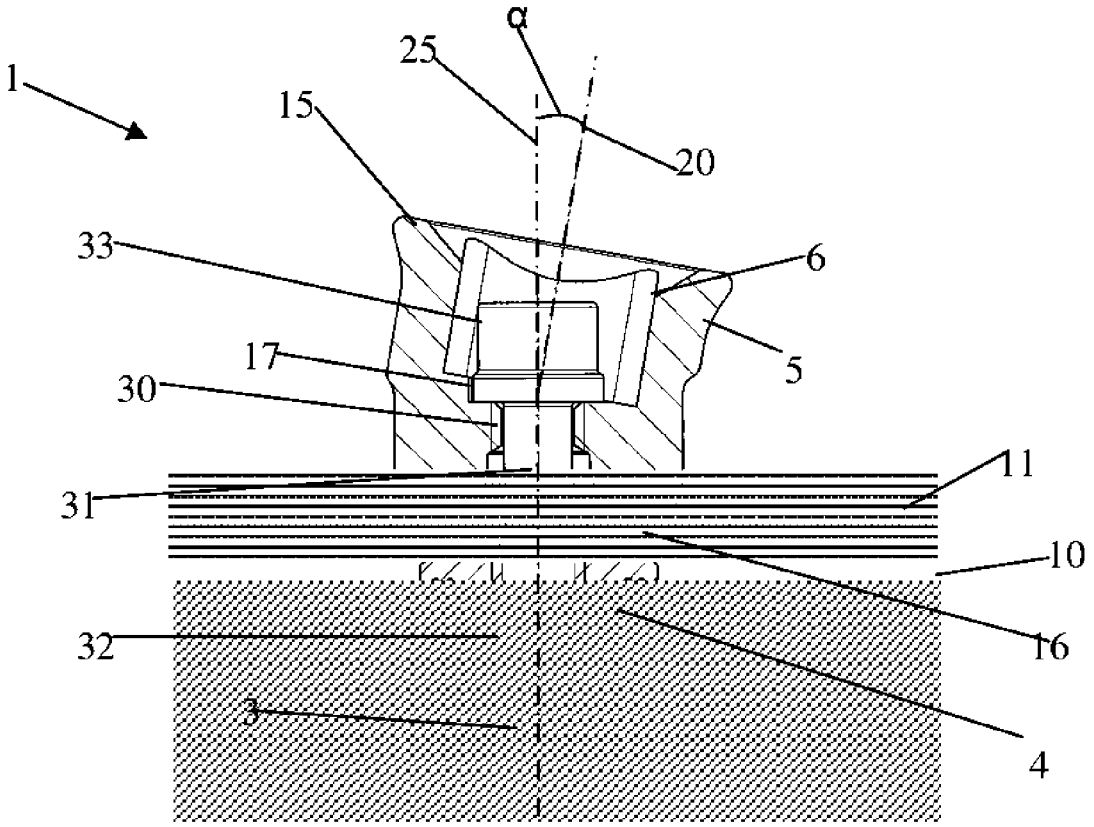
FIG. 2 shows a sectional side view of the angled abutment with the connection screw joined with the implant fixture.
Figure 3:
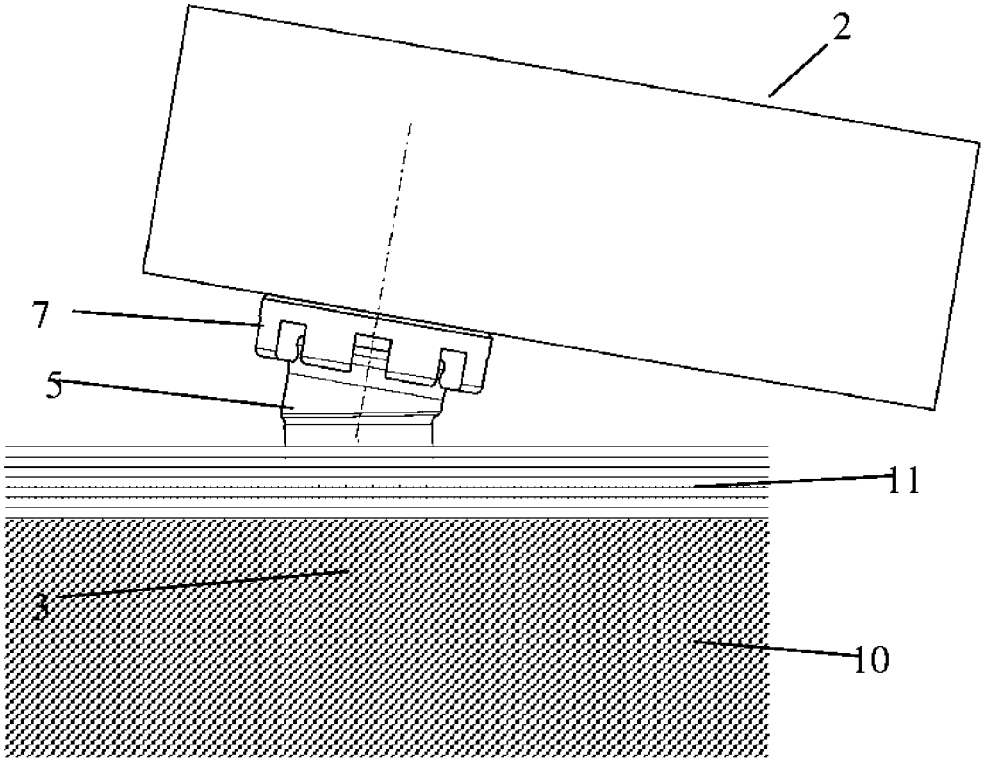
FIG. 3 shows a bone anchored hearing aid attached to the angled abutment.
Figure 4:
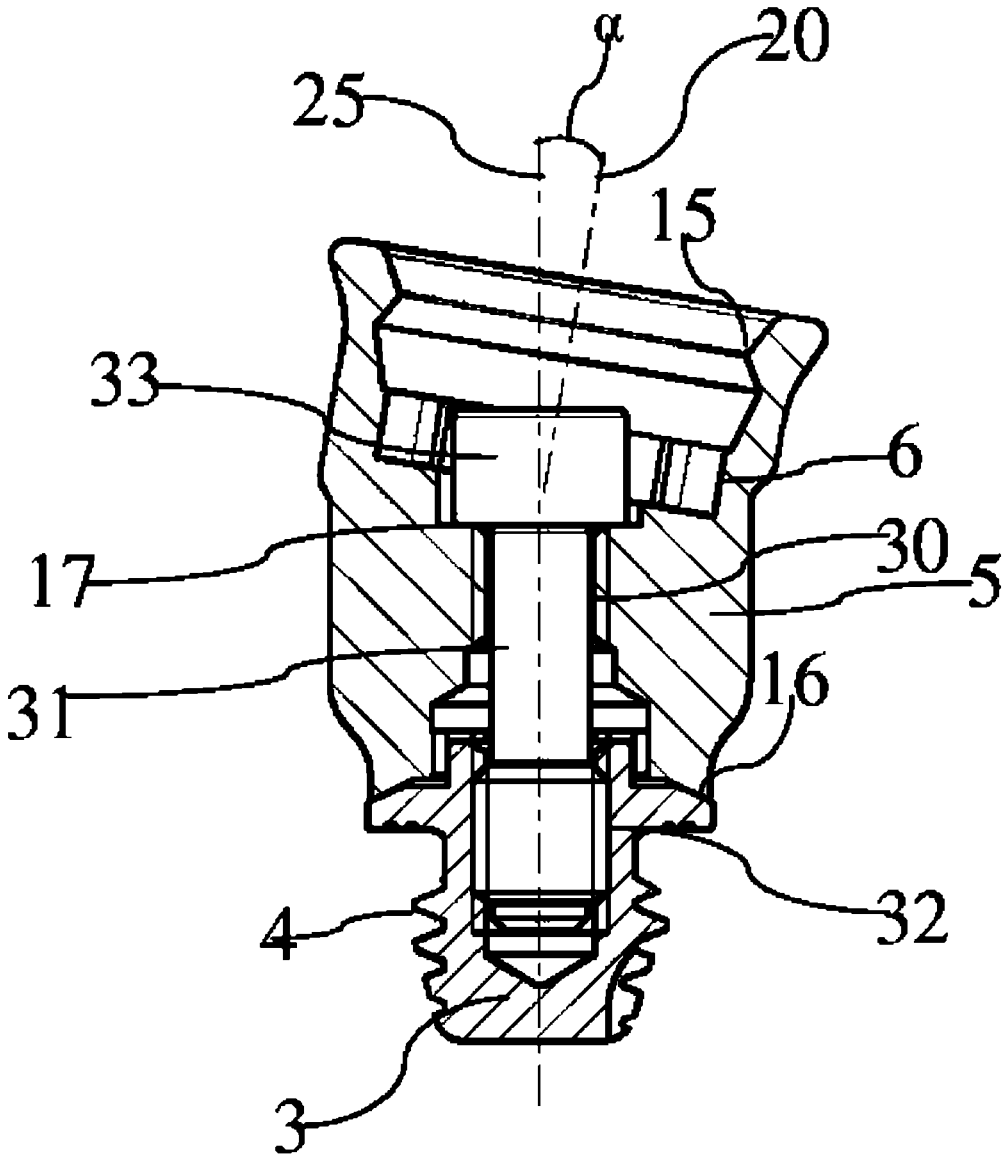
FIG. 4 shows a sectional side view of the angled abutment, with an internal flange portion arranged for the connection of a vibrator unit.
Figure 5:
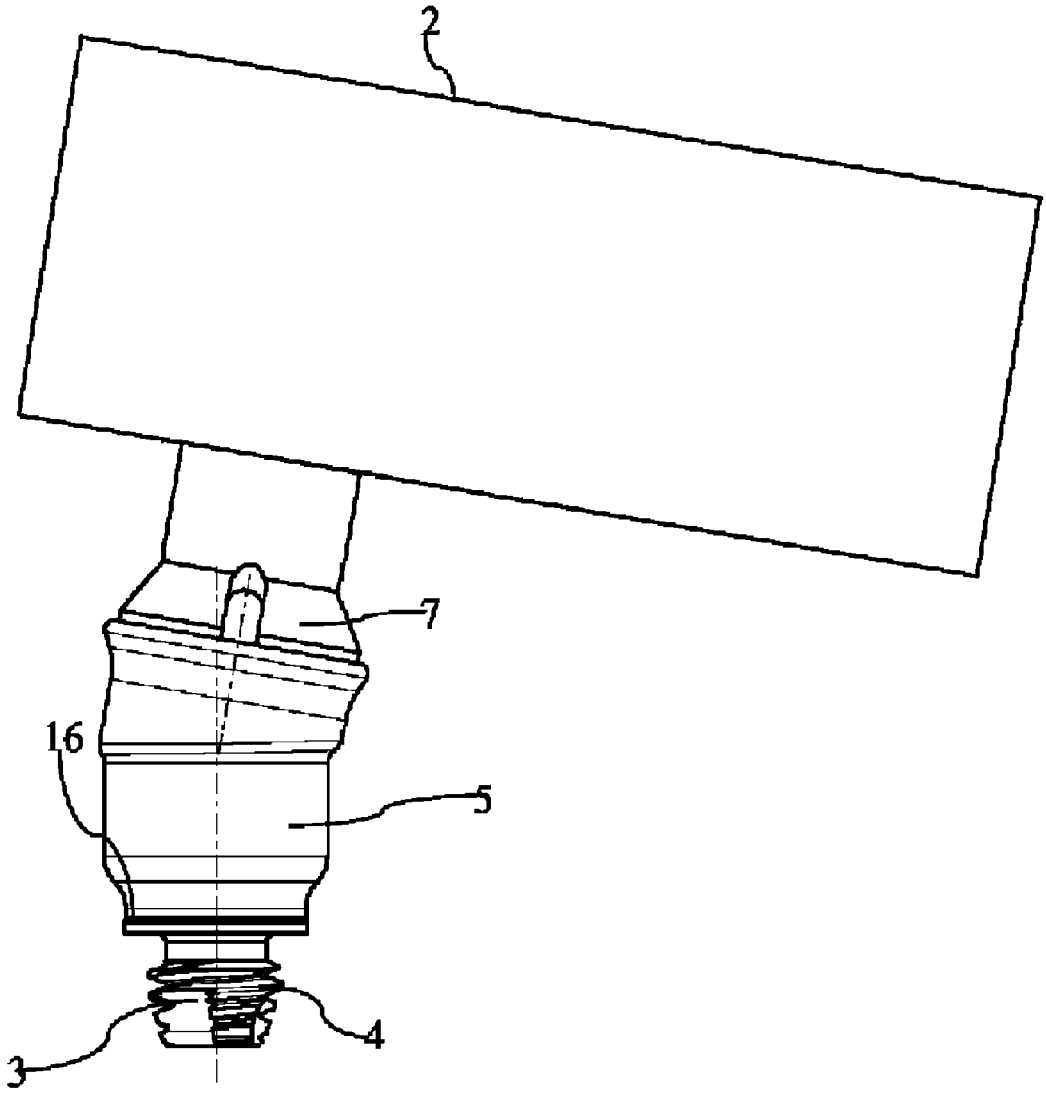
FIG. 5 shows a bone anchored hearing aid attached to the angled abutment at the internal flange portion thereof.

A hearing-aid attachment system 1 for connection of a bone conduction hearing aid (FIG. 3, position No 2) to an osseointegrated implant 3 is shown in FIG. 2 and FIG. 4. The system comprises an implant 3 which is fixated in the bone 10 of a wearer as especially indicated in FIGS. 2 and 3. As seen in the figures the implant 3 comprises a screw 3 with an external thread 4, and an abutment 5 that goes through the skin 11. A hearing aid 2 has a coupling 7 that allows the hearing aid 2 to be connected to the abutment 5, as is seen in FIGS. 3 and 5. To this end the abutment 5 has a coupling surface 15 at its lateral end. (With "lateral" is to be understood a direction away from the bone or skin surface whereas contra-lateral is to be understood as a direction towards the skin and bone surface of a wearer) This coupling surface 15 is in contact with the hearing aid coupling 7. In the embodiment in FIGS. 4 and 5, the coupling surface is provided at an internal circumference of the cup shaped abutment 5. As seen in FIGS. 3 and 5, the axial orientation of the hearing aid coupling 7 in relation to the implanted screw 3 is decided by the axial orientation of the coupling surface 15 when the hearing aid 2 is attached to the abutment 5. The abutment 5 has an implant contact surface 16 at a contra-lateral end thereof and this surface 16 is in contact with a lateral end of the implant 3. A hearing aid coupling axis 20 is defined by the coupling surface 15, and an implant axis 25 is defined by the implant screw 3. As seen in FIG. 1 the abutment is designed so that there is an angle $\alpha$ between the hearing aid coupling axis 20 and the implant axis 25.

Generally the implant screw 3 is to be implanted perpendicular to the bone surface, but this is not always a well defined direction as the surface of the bone is not necessarily even, and also during the implant procedure some variation in the screw placement may follow due to the craftsman nature of this procedure.

The angle $\alpha$ is preferably in the range between 5 and 20 degrees.

Preferably the angle α is provided by an angulation of the coupling surface 15 and the contact surface 16 with respect to each other.

Both the coupling surface 15 and the contact surface 16 are circular. This allows the abutment 5 to be turned around the axis 25 and fastened at any rotational angle with respect to the implant screw 3, whereby the angle α may be freely rotated about the implant axis 25.

As seen in FIGS. 1, 2 and 4, the abutment has a central hole 30 and a connection screw 31 where, as further seen in FIGS. 2 and 4 the implant 3 has a threaded inner hole 32 for the connection screw 31. The axial orientation of the connection screw 31 corresponds to the axial orientation of the implant screw 3.

At the lateral end the abutment 5 comprises a recess 6, which is shaped such that a head 33 of screw 31 may be seated therein. The recess 6 thus comprises a seat surface 17 for the screw head 33 arranged perpendicular to the implant axis 25. In this way the head 33 of the connection screw 31 can be accessed from the lateral end of the abutment 5, and the screw 31 may be tightened in the threaded hole 32 to establish a strong sealing force between the abutment contact surface 16 and the implanted screw 3, through tightening forces imparted onto the surface 17.

In a further embodiment (not shown in the drawing) the abutment coupling contact surface is a spherical surface and the hearing aid coupling has a corresponding reverse spherical surface, and further, the hearing aid coupling is magnetically attached to the abutment coupling contact surface. This allows the angle α to be varied by attaching the hearing aid coupling on different locations on the spherical abutment coupling contact surface.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

The invention claimed is:

1. Bone anchored bone conductive hearing aid which has a bone implantable screw (3) with an implant axis (25) intended to be generally perpendicular to a bone surface at an implant point and a skin penetrating abutment (5) which is connected to the implantable screw (3) through a contact surface (16) at a contra-lateral end thereof where the abutment (5) at a lateral end thereof has a coupling surface (15) whereto a hearing aid is detachably coupled along a hearing aid coupling axis (20), wherein the implant axis (25) and the hearing aid coupling axis (20) are arranged at an angle α with respect to each other.

2. Bone anchored bone conductive hearing aid as claimed in claim 1 wherein the angle α is in the range between 5 and 20 degrees.

3. Bone anchored bone conductive hearing aid as claimed in claim 2 wherein the coupling surface (15) and the contact surface of the abutment (5) are circular.

4. Bone anchored bone conductive hearing aid as claimed in claim 3 wherein the abutment comprise a through going hole (30) for a fastening screw (31), and where the screw and screw hole is aligned along the implant axis (25).

5. Bone anchored bone conductive hearing aid as claimed in claim 4 wherein a recess (6) is provided at the lateral end of the abutment (5) for receiving a screw head (33) of the fastening screw (31).

6. Bone anchored bone conductive hearing aid as claimed in claim 5 wherein the recess (6) at the contra lateral end thereof comprise a seat surface for the screw head (33) arranged perpendicular to the implant axis (25).

7. Bone anchored bone conductive hearing aid as claimed in claim 1 wherein the hearing aid is magnetically attached to the skin penetrating abutment (5).

* * * * *